US009480300B2

(12) United States Patent
McDonnell, Jr. et al.

(10) Patent No.: US 9,480,300 B2
(45) Date of Patent: Nov. 1, 2016

(54) ORTHOTIC DEVICE

(71) Applicants: Michael T McDonnell, Jr., Wynnewood, PA (US); George Robert Simmons, III, Haddon Heights, NJ (US); Sean James Wilson, Kinnelon, NJ (US); Brendan Michael Kearney, Conshohocken, PA (US); Jess Ethan Swaringen, Oak Bluffs, MA (US); Lester James McMackin, Ocean Springs, MS (US); Sarah Ann Oliveri, Elm Grove, WI (US); Berjamin Alan Inkrott, Ottawa, OH (US); Megan Elizabeth Braisted, Tipp City, OH (US); Brian Joseph Walsh, Bethel Park, PA (US)

(72) Inventors: Michael T McDonnell, Jr., Wynnewood, PA (US); George Robert Simmons, III, Haddon Heights, NJ (US); Sean James Wilson, Kinnelon, NJ (US); Brendan Michael Kearney, Conshohocken, PA (US); Jess Ethan Swaringen, Oak Bluffs, MA (US); Lester James McMackin, Ocean Springs, MS (US); Sarah Ann Oliveri, Elm Grove, WI (US); Berjamin Alan Inkrott, Ottawa, OH (US); Megan Elizabeth Braisted, Tipp City, OH (US); Brian Joseph Walsh, Bethel Park, PA (US)

(73) Assignee: Ellen M. And Michael T. McDonnell Jr. Family Foundation, Havertown, PA (US)

( * ) Notice: Subject to any disclaimer, the term of this patent is extended or adjusted under 35 U.S.C. 154(b) by 876 days.

(21) Appl. No.: 13/842,811

(22) Filed: Mar. 15, 2013

(65) Prior Publication Data

US 2014/0259799 A1 Sep. 18, 2014

(51) Int. Cl.

| | |
|---|---|
| ***A61F 5/00*** | (2006.01) |
| ***A43B 7/20*** | (2006.01) |
| ***A43B 3/00*** | (2006.01) |

(52) U.S. Cl.
CPC ..... *A43B 7/20* (2013.01); *A43B 3/0015* (2013.01)

(58) Field of Classification Search
CPC .... A43B 7/20; A43B 13/188; A43B 17/003; A43B 17/14; A43B 3/0015; A43B 13/182; A43B 13/183; A43B 17/00; A43B 21/30; A43B 7/14; A43B 7/141; A43B 7/142; A43B 7/22; A43B 7/30; A63D 1/02; A61H 1/024; A61H 1/0244; A61H 1/0266; A61H 2201/1215; A61H 2201/1238; A61H 2201/1246; A61H 2201/1652; A61H 2201/1664; A61H 2201/5061; A61H 2201/5064; B29D 35/061; B29D 35/142; B29D 35/148; A61B 5/1038; A61B 5/1071; A61B 5/112; A61B 5/1123; A61B 5/4528; A61B 5/4585; A61B 5/4595; A61F 2005/0169; A61F 5/0123; A61F 2002/5066; A61F 2002/704; A61F 2/6607; A61F 2002/5003; B65H 1/04; B65H 1/14; B65H 2301/4234; B65H 2402/64; B65H 2403/512; B65H 2405/1117; B65H 3/06; B65H 5/06; B65H 31/02; B65H 31/3081
USPC ..... 602/16; 128/882
See application file for complete search history.

(56) References Cited

U.S. PATENT DOCUMENTS 2,439,100 A * 4/1948 Richards ..... A61F 5/0127 602/28

(Continued)

OTHER PUBLICATIONS

Yong-Lae Park, Bio-Inspired Active Soft Orthotic Device for Ankle Foot Pathologies, 8 pages.

*Primary Examiner* — Michael Brown
(74) *Attorney, Agent, or Firm* — Finnegan, Henderson, Farabow, Garrett & Dunner, LLP

(57) ABSTRACT

An orthotic device is disclosed having a frame system, a first actuator, and a second actuator. The frame system may include a lightweight supportive material, and may be configured to receive a user's foot. The first actuator may be coupled to the frame system, and may be configured to activate and develop push of the forefoot of the user's foot during a walking step. The second actuator may be coupled to the frame system, and may be configured to activate and raise a user's toes.

29 Claims, 9 Drawing Sheets

(56) References Cited

U.S. PATENT DOCUMENTS 5,476,441 A * 12/1995 Durfee ..... A61N 1/36003 434/112
8,114,042 B2 * 2/2012 Klotz ..... A61F 5/0113 2/467
2009/0171469 A1 * 7/2009 Thorsteinsson ..... A61B 5/1038 623/26
2010/0312361 A1 * 12/2010 Martin ..... A61F 2/68 623/34
2012/0238914 A1 9/2012 Goldfield et al.

* cited by examiner

ORTHOTIC DEVICE

TECHNICAL FIELD

The present disclosure is related to an orthotic device and, more particularly, to an orthotic device used to treat gait abnormalities.

BACKGROUND

Gait abnormalities may be a result of a variety of disorders. Drop foot includes one form of gait abnormality associated with a dropping of the forefoot. Users suffering from drop foot may have limited mobility with movement of the toes and ankle, causing the foot to hang down and turn inward. These users may be unable to lift their toes during a gait cycle, and therefore may drag their toes while taking a step. This may cause difficulty with walking, and users may often stumble and fall. Additionally, users may compensate for the dragging by bending the knee to lift the foot higher than normal.

Drop foot may also cause the inability for users to control the falling of their forefoot after striking their heel to the ground while walking. The foot will slap down after the heel has touched the ground, causing a condition known as "slap foot". This condition is caused by impairment of the user's dorsiflexor muscles, which are used to lift the forefoot during a gait cycle.

Drop foot may be caused by various muscular and/or neurological disorders. Users suffering from muscular dystrophy, polio, diabetes, Charcot-Marie-Tooth disease, and established compartment syndrome may experience drop foot. Additionally, this gait abnormality may be a result of spinal cord injury or brain injury diseases including stroke, Parkinson's disease, and multiple sclerosis. Nerve damage, for example, from a herniated disc, fractured pelvis, hip dislocation, and knee dislocation may affect a user's peroneal nerve and also cause the user to develop drop foot.

Conventional treatment of drop foot, and other gait abnormalities, includes a brace to stabilize the ankle and toes while walking. A brace may hold a user's toe upward while taking a step and prevent dragging of the toes. Such braces may include a frame and an attachment member. The frame may be disposed around a user's leg or ankle while the attachment member connects a user's shoe to the frame, to hold the toes upward.

Conventional braces may produce a limited range of motion for a user. Such braces may hold a foot in a horizontal or 90 degree position with a leg. Therefore, the user may not be able to rotate the foot while taking a step and lift off with the toes when stepping forward. Instead, the user may step down and lift off with a flat foot. Additionally, conventional braces may be bulky and require attachment to a particular shoe type. This may limit the wardrobe the user may wear with the brace, and may cause some users to not wear the brace.

The present disclosure overcomes at least some of the problems associated with traditional braces.

SUMMARY

The present disclosure is directed to an orthotic device including a frame system comprising a lightweight supportive material. The frame system may be configured to receive a user's foot. A first actuator may be coupled to the user's foot, and may be configured to activate and develop push off of the forefoot of the user's foot during a walking step. A second actuator may be coupled to the frame system, and may be configured to activate and raise the user's toes.

The present disclosure is directed to an orthotic device including a foot plate, a heel brace, and a leg holder. The foot plate may be configured to receive a user's foot. The heel brace may be connected to the foot plate and configured to receive the user's heel. The leg holder may be pivotally connected to the heel brace. Additionally, the orthotic device may include a first actuator, extending from the leg holder to the heel brace, and a second actuator, extending from the leg holder to the foot plate.

DETAILED DESCRIPTION

Figure 1A:
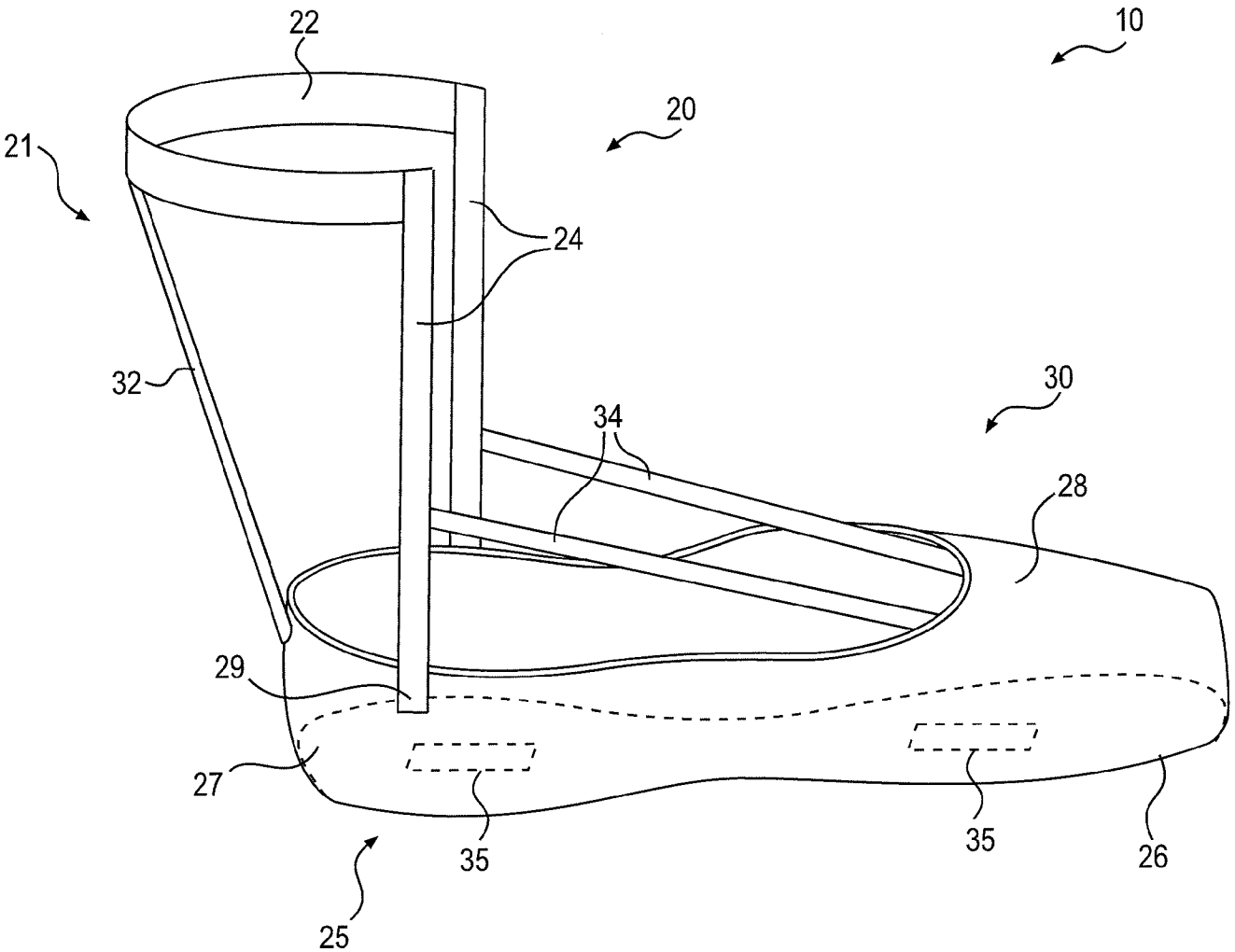
FIG. 1A includes a schematic illustration of an exemplary orthotic device.
Figure 1B:
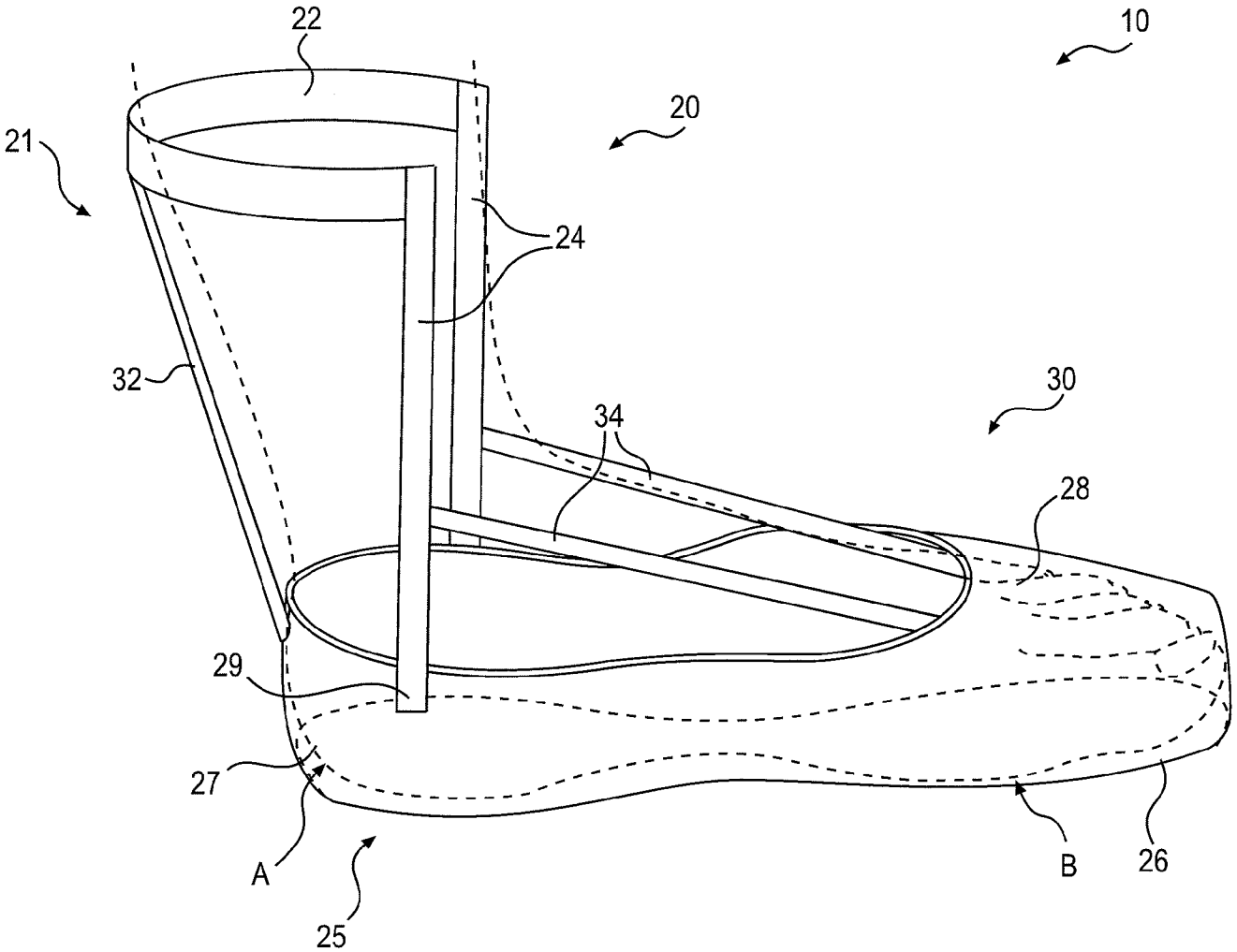
FIG. 1B includes another schematic illustration of the exemplary orthotic device of FIG. 1A.

FIGS. 1A and 1B illustrate an exemplary disclosed orthotic device 10 including a frame system 20 and an actuating system 30. Orthotic device 10 may be configured for attachment to a user's lower leg and footwear to stabilize the user's foot while walking, and produce an improved walking gait. Additionally or alternatively, orthotic device 10 may be configured for attachment to a user's lower leg and foot. Frame system 20 may be dynamically coupled with actuating system 30 to stabilize the user's foot. Frame system 20 may provide structural support for a user's foot, and actuating system 30 may be configured to respond to movement of the user's body. As discussed in more detail below, actuating system 30 may be configured to transmit forces to and from the user, and assist the user with walking and rehabilitation.

Frame system 20 may include an upper frame 21 and a lower frame 25. As shown in FIGS. 1A and 1B, upper frame 21 may include a leg holder 22 and one or more leg sections 24. Leg holder 22 may be securable to a user's lower leg, for example, below the knee. Additionally, leg holder 22 may include an arcuate cuff member configured to accept the user's lower leg. Leg holder 22 may extend partially or completely around a user's leg. In some embodiments, leg holder 22 may include a shape and dimensions tailored for an individual user. Leg sections 24 may include a vertical orientation extending from leg holder 22 towards lower frame 25, and may be formed as a unitary member with leg holder 22. However, in other embodiments, leg sections 24 and leg holder 22 may be secured with any fastening mechanism known in the art, such as, for example, bonding materials, screw, nut, bolt, welding, Velcro™ fasteners, etc. In the embodiment of FIGS. 1A and 1B, two leg sections 24 connect leg holder with lower frame 25. However, it is contemplated that orthotic device 10 may include one, three, four, etc. leg sections 24.

Lower frame 25 may include a foot plate 26, a heel brace 27, and a foot brace 28. Foot plate 26 may include a substantially flat member configured to accept a user's foot. In some embodiments, lower frame 25 may form a foot insert configured to fit within a user's shoe, and foot plate 26 may include, for example, one or more indentations or protrusions configured to conform to a user's heel (i.e., hindfoot), arch (i.e., midfoot), or ball and toes (i.e., forefoot). In other embodiments, lower frame 25 may be configured to receive a user's shoe and be worn external of the shoe. As shown in FIGS. 1A and 1B, foot plate 26 may be secured to heel brace 27. In some embodiments, foot plate 26 and heel brace 27 may be formed as one unitary member. However, in other embodiments, foot plate 26 and heel brace 27 may be secured with any fastening mechanism known in the art, such as, for example, bonding materials, screw, nut, bolt, welding, Velcro™ fasteners, etc. Heel brace 27 may include one or more sidewalls configured to accept a user's heel. The one or more sidewalls may each be rounded or square in shape.

Foot plate 26 may additionally be secured to foot brace 28. In some embodiments, foot plate 26 and foot brace 28 may be formed as one unitary member. However, in other embodiments, foot plate 26 and foot brace 28 may be secured with any fastening mechanism known in the art, such as, for example, bonding materials, screw, nut, bolt, welding, Velcro™ fasteners, etc. Alternatively, foot plate 26 and foot brace 28 may be integrally formed as a shoe insert and substantially conform to the shape of a user's foot. Foot brace 28 may include an arcuate member configured to accept a user's forefoot, such that foot brace 28 may be disposed over the foot. Therefore, orthotic device 10 may stabilize a user's foot disposed between foot plate 26 and foot brace 28 when the user walks.

Foot brace 28 may be directly connected with heel brace 27, or may be indirectly connected with heel brace 27 through foot plate 26. In the embodiment of FIGS. 1A and 1B, foot brace 28 and heel brace 27 may include one unitary member formed to surround at least a portion of the user's foot or shoe. For example, foot brace 28 and heel brace 27 may be formed as a slipper, which fits within the user's shoe, or an overshoe, which is configured to fit outside the shoe.

Figure 2:
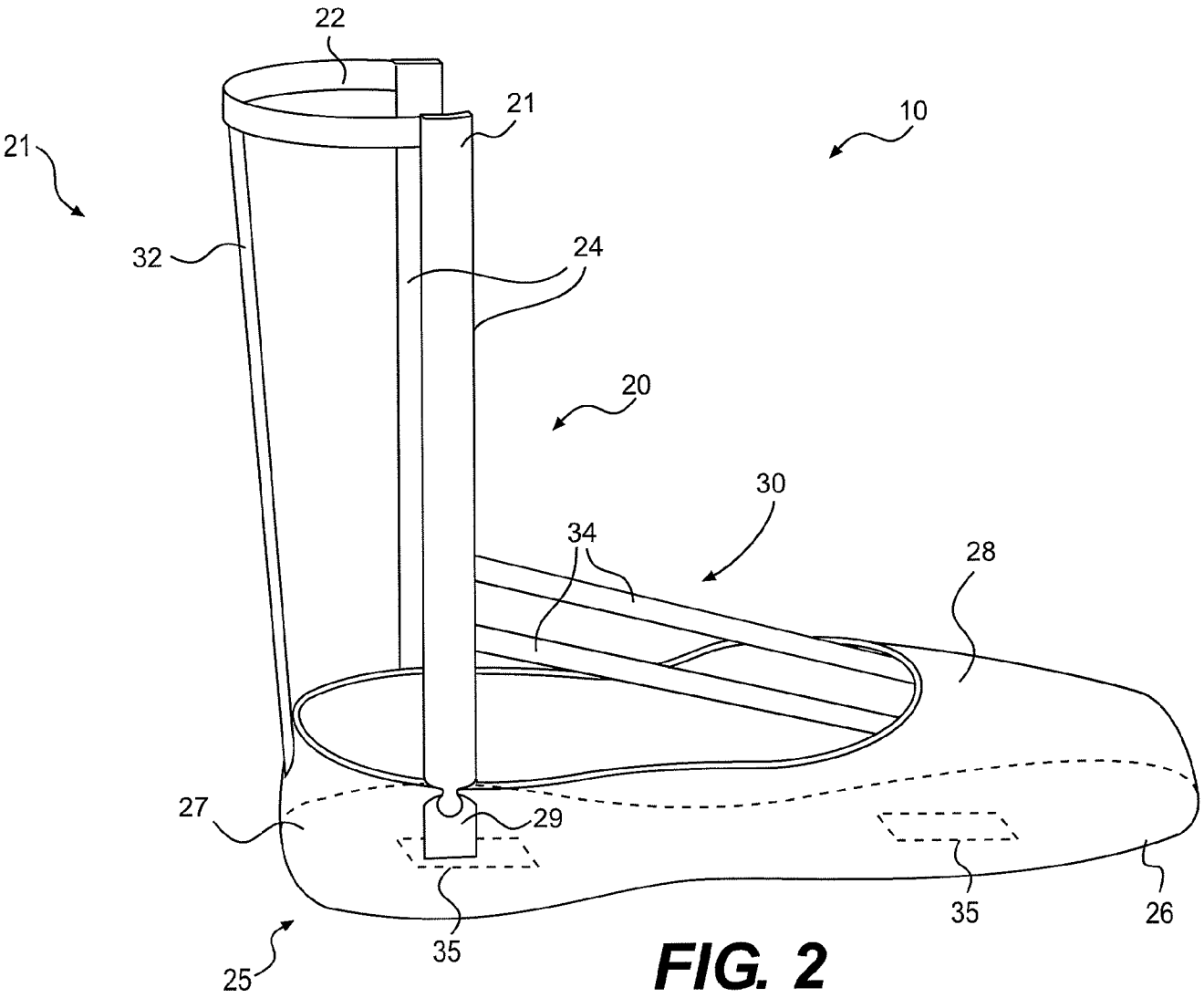
FIG. 2 includes another schematic illustration of the exemplary orthotic device of FIG. 1A.
Figure 3:
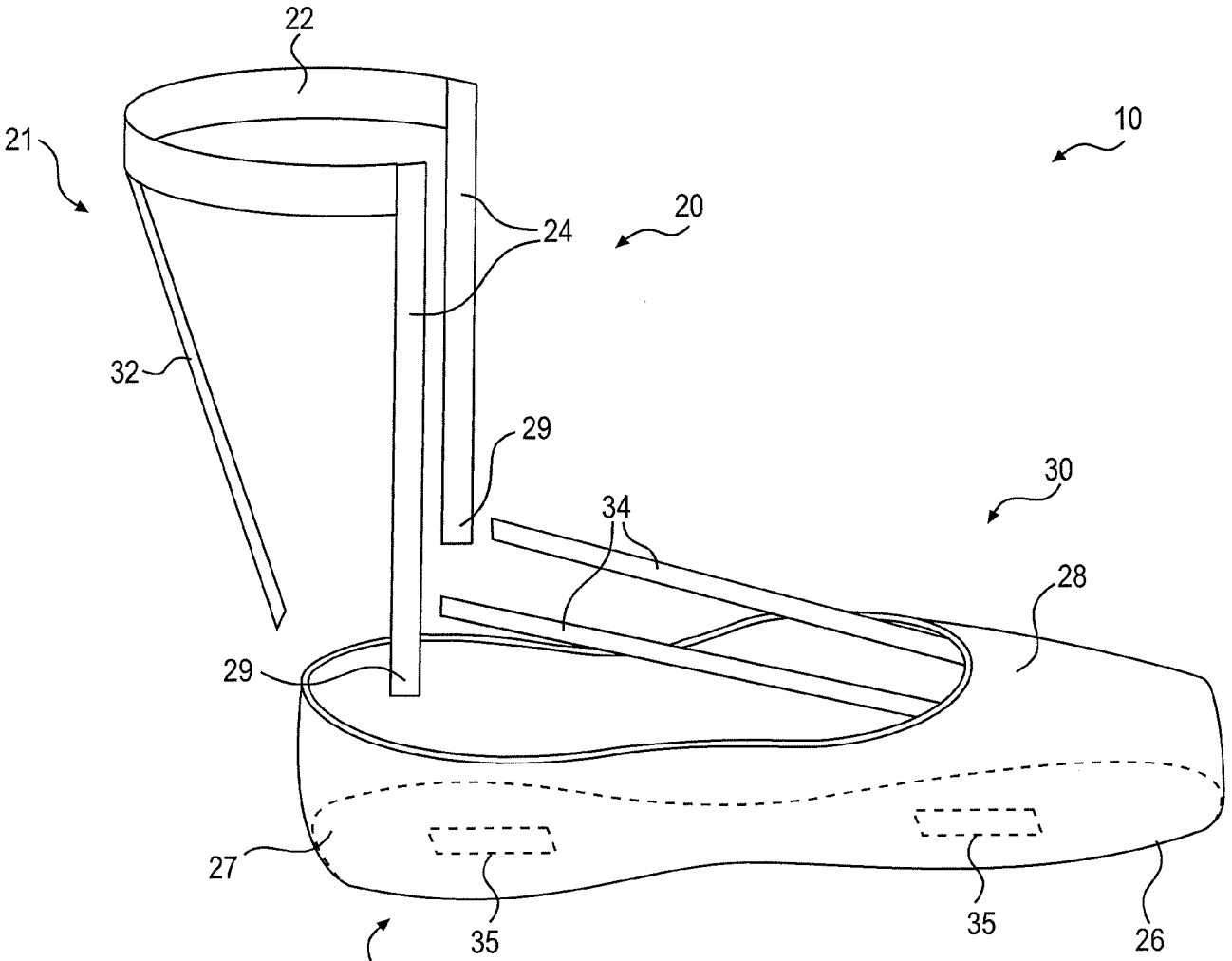
FIG. 3 includes another schematic illustration of the exemplary orthotic device of FIG. 1A.

Leg sections 24 may be removably coupled to lower frame 25 through joint 29. As shown in FIGS. 2 and 3, upper frame 21 may be selectively attached or removed from lower frame 25. Joint 29 may include any removable connection, such as an interference connection, a pin and slot connection, a pivot pin, or a ball and joint among other types of connections known in the art. Additionally or alternatively, joint 29 may include a hinge or flexible connection, and may allow leg sections 24 and leg holder 22 to pivot around joint 29 with respect to heel brace 27. FIG. 2 shows one embodiment of a ball and joint connection between leg sections 24 and heel brace 27. In this embodiment, a ball may be inserted within a fixed plate to provide rotation of joint 29 in multiple directions. Joint 29 may be configured to pivot forward and backward and left and right, and form a variety of angles between leg sections 24 and foot plate 26. Therefore, joint 29 may be configured to stimulate the motion of a user's ankle. Movement of a user's leg backward while walking may be sufficient to pivot leg sections 24 and leg holder 22 backward. In other embodiments, joint 29 may provide a fixed connection between leg sections 24 and heel brace 27. Joint 29 may be configured to attach lower frame 25 with upper frame 25 after a user's foot has been placed within lower frame 25.

Figure 4:
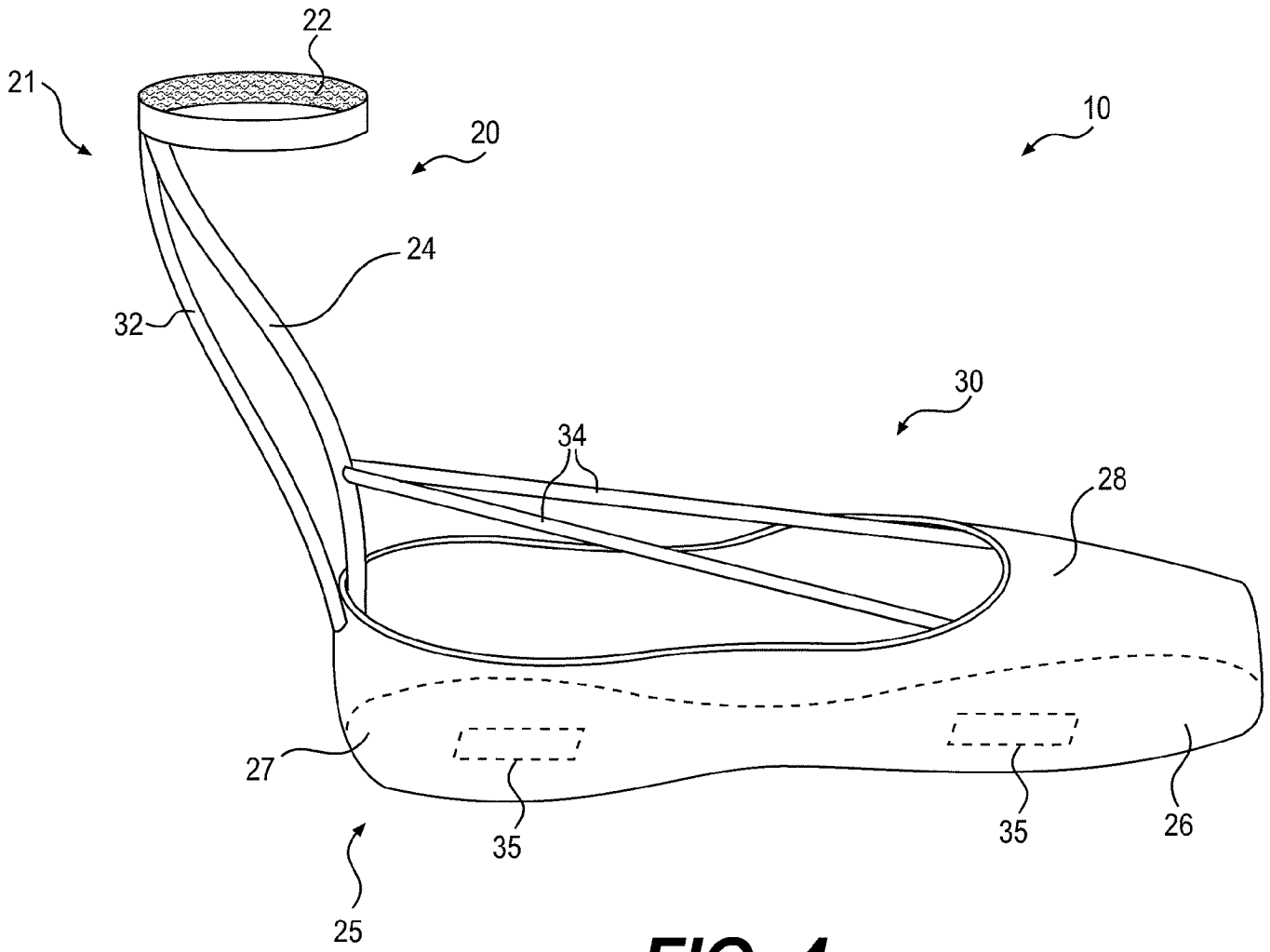
FIG. 4 includes a schematic illustration of another exemplary orthotic device.

Alternatively, as shown in FIG. 4, upper frame 21 may comprise a material sufficiently flexible to bend and flex forward and backward and left and right, and form a variety of angles between leg section 24 and foot plate 26. Movement of a user's leg backward while walking may be sufficient to flex upper frame 21 backward. In the embodiment of FIG. 4, upper frame 21 may include one leg section 24 shaped to contour a user's leg and calf muscle, and the one leg section 24 may flex with respect to heel brace 27. In this embodiment, leg holder 22 may include a circular member configured to encircle a user's leg. Leg holder 22 may include a flexible strap or a rigid material including Velcro™ or an adhesive material. The strap may open or close to accept a user's leg and close around the user's leg.

It is further contemplated that leg section 24 may include a spring configured to propel a user forward when walking. As shown in FIG. 4, leg section 24 may include a torsion spring, and the torsion spring may store energy when a user steps down and release this stored energy when a user pushes off from the ground. Therefore, leg section 24 may be configured to develop a continuing motion for the user that reduces the amount of energy required for a user to step forward. In other embodiments, the spring may include a flexible rod or blade, for example a rod of blade comprised of carbon fiber.

Frame system 20 may include one or more supportive materials. Sufficient materials may include lightweight and compact materials configured to be wear resistant. In one embodiment, frame system 20 may include carbon fiber, for example, a carbon fiber reinforced material. In other embodiments, frame system 20 may be comprised of aramid fibers, resin, including resin impregnated glass, and polymers such as polyethylene or polyurethane. However, it is contemplated any other material suitable for an orthotic device may be used. In certain aspects, one or more components of frame system 20 may include cushioning material, such as padding, foam, or a textile component.

Upper frame 21 may include one or more materials different from lower frame 25. For example, upper frame 21 may comprise a substantially rigid material, such as, for example, carbon fiber, and lower frame 25 may comprise a substantially flexible material configured to substantially mold to a patient's foot, including but not limited to, thermoplastic resin, natural and man-made rubbers, and cellular foam. It is further contemplated that foot plate 26 may be sufficiently flexible to flex upward and downward with a user's forefoot when walking. In one embodiment, foot plate 26 may include a hinge or joint configured to flex and pivot when a user pushes off from the ground.

Figure 5:
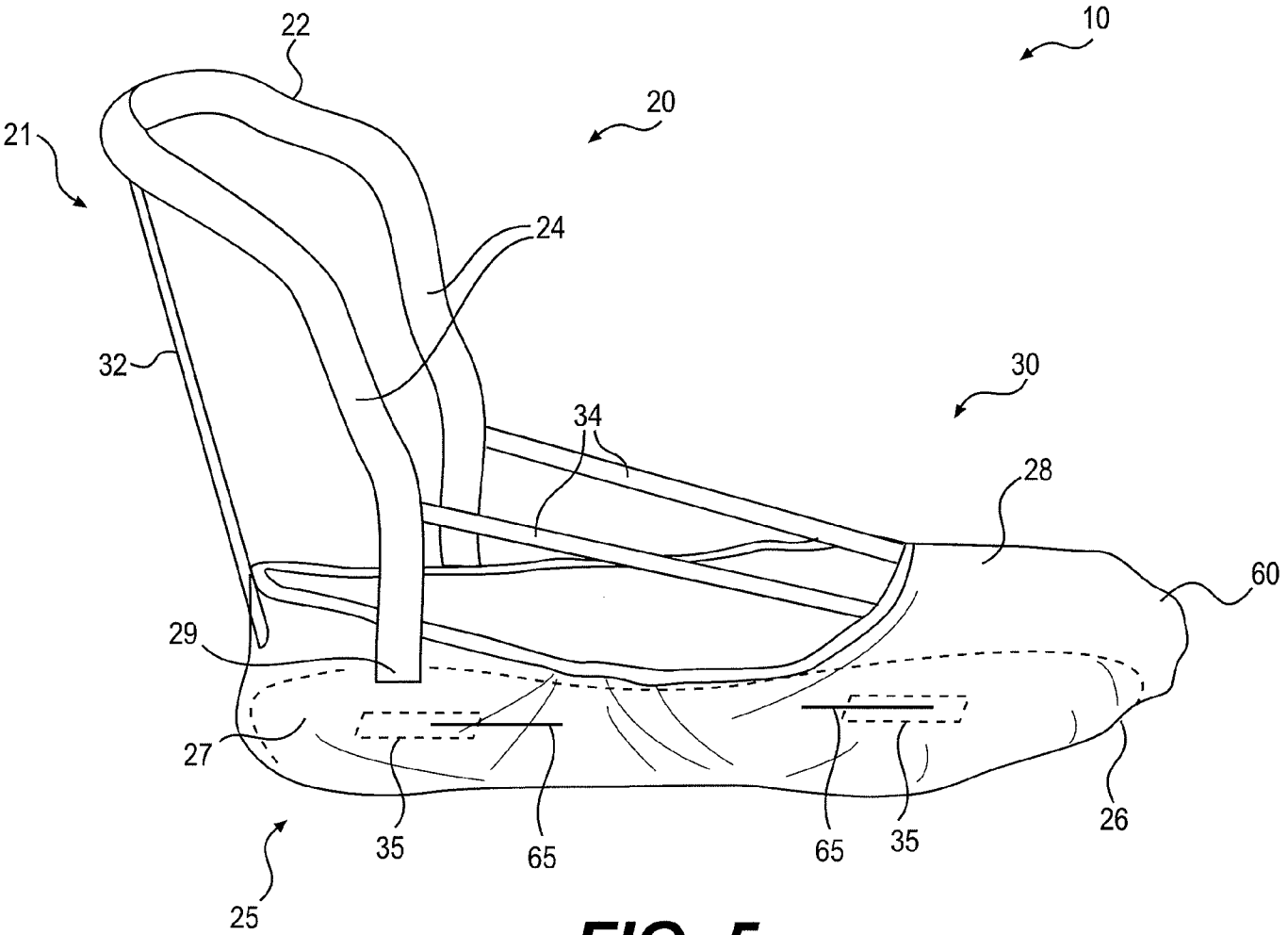
FIG. 5 includes a schematic illustration of another exemplary orthotic device.

In some embodiments, frame system 20 may include an inflatable bladder 60 configured to form a substantially flexible structure when deflated and a substantially rigid structure when inflated, as shown in FIG. 5. For example, the deflated structure may allow a user to easily place the user's foot within frame system 20. The inflated structure may conform to the user's foot and leg, and may provide a supportive frame structure. Upper frame 21 and lower frame 25 may comprise inflatable bladder 60. In other embodiments, upper frame 21 may comprise inflatable bladder 60 and lower frame 25 may comprise a non-inflatable material. Inflatable bladder 60 may include, for example, an elastomer configured to inflate with fluid or air. In one example, inflatable bladder 60 may be selectively connected to a pump (not shown). Inflatable bladder 60 may include one or more supportive members 65 configured to provide form and structural support to inflatable bladder 60. Supportive members 65 may include, for example, wires or rods formed of metal or plastic. In one example, supportive members 65 may include elastic wires capable of elongating.

Frame system 20 may conform to a user's leg and foot, allowing orthotic device 10 to be worn under a user's clothing. For example, frame system 20 may be compact in design and configured to be concealed when worn. In one embodiment, at least portions of orthotic device 20 may be configured to be disposed within seams of a user's clothing. Additionally, orthotic device 10 may be configured to be worn with a variety of shoes, including boots, sneakers, high heels, and sandals. In the embodiment of FIG. 2, a user's left foot is inserted within orthotic device 10.

Figure 6:
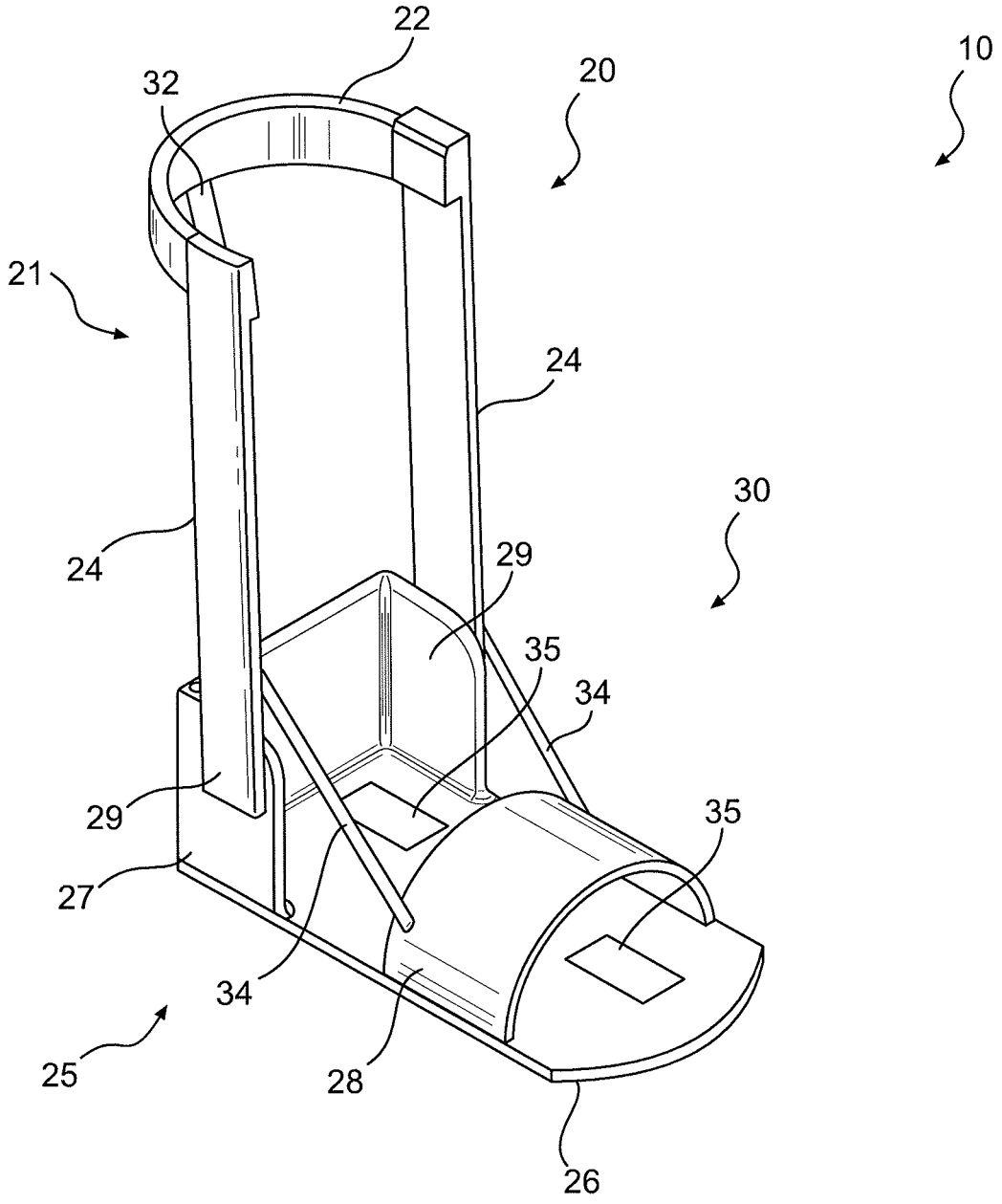
FIG. 6 includes a schematic illustration of another exemplary orthotic device.

As shown in the embodiment of FIG. 6, frame system 20 may be configured to be disposed over and around a user's shoe. In this embodiment, heel brace 27 may be separated from toe brace 28, and toe brace 28 may form an arched semi-circle. Therefore, heel brace 27 and toe brace 28 may be configured to provide sufficient room for a shoe to be disposed within lower frame 25. In other embodiments, toe brace 28 may include an attachment mechanism sufficient to attach lower frame 25 to a user's shoe.

Actuating system 30 may include independently adjusted actuators 32, 34 in communication with sensor 35 and controller 37 to adjustably position a user's foot. Actuators 32, 34 may function as artificial muscles, and may be configured to adjust orientation of frame system 20. Specifically, actuators 32, 34 may be configured to adjust orientation of lower frame 25 relative to upper frame 21. As shown in FIGS. 1 and 2, actuator 32 may include one or more independently activated actuators connecting heel brace 27 with leg holder 22. In other embodiments, actuator 32 may include one or more actuators connecting foot plate 26 with leg holder 22. Actuator 32 may be removably connected with heel brace 27 or foot plate 26 (FIG. 3). Actuator 34 may include one or more independently activated actuators extending from leg sections 24 toward foot plate 28, and connecting leg sections 24 with foot brace 28 or foot plate 26. In other embodiments, actuator 34 may include one or more actuators extending from heel brace 27 toward foot plate 26 and connecting heel brace 27 with foot brace 28. Actuator 34 may be removably connected with leg sections 24 or heel brace 27 (FIG. 3). In the disclosed embodiment, actuator 32 includes one actuator and actuator 34 may include two actuators, each extending on opposite sides of foot plate 26. It is further contemplated that actuators 32, 34 may be separate from frame system 20 and located proximate to frame system 20.

Sensor 35 may include one or more sensors in communication with frame system 20 and configured to detect a change in foot motion or orientation to determine if a user is walking with a substantially normal gait. In some embodiments, sensor 35 may be configured to detect gait sequence, gait speed, the location of a foot in relation to the user's body or ground, the angle of the foot, the foot placement, etc. For example, in one embodiment, sensor 35 may be configured to detect when a user's foot strikes the ground and the foot placement on the ground. Additionally or alternatively, sensor 35 may be configured to detect the angled position of a user or the change in acceleration of the user. Sensor 35 may be positioned in proximity to the user's foot and to actuators 32, 34. As shown in FIGS. 1A and 1B, sensor 35 may include, for example, two sensor pads disposed on foot plate 26. In other embodiments, sensor 35 may be disposed at various positions on a user including, for example, a user's leg, knee, ankle, or any position on the user's body. It is further contemplated that the sensors 35 may be disposed at more than one location on a user. For example, in one embodiment, sensor 35 may include one or more sensors on foot plate 26 and one or more sensors on the user's knee.

Sensor 35 may be configured to convert changes in mechanical force to changes in electrical signals. For example, sensor 35 may include switches, strain gauges, inclinometers, or accelerometers. Additionally, sensor 35 may include one or more wireless components, such as a key fob, configured to remotely communicate with frame system 20 or a controller 37. In some embodiments, sensor 35 may include a pressure pad comprising a plurality of inflatable pockets filled with liquid or air. The pockets may be opened or closed, allowing for inflation and deflation of the liquid and air, depending on the placement of a foot during a gait cycle. For example, a foot strike may increase the pressure within the inflatable pockets, while a step off the ground may decrease the pressure. Sensor 35 may measure the air or liquid pressure within each inflatable pocket, and may convert the pressure measurement into an output signal.

In some embodiments, sensor 35 may include one or more sensors configured to detect a user's body motion or orientation to determine the walking intention of the user. For example, sensor 35 may be configured to detect when a user lean forwards, leans to the right or left, a pivot in the user's hips left or right, a pivot in the user's torso left or right, etc. In one embodiment, a lean forward by a user may indicate the user's intention to walk faster. In another embodiment, a pivot of the user's hips to the right may indicate the user's intention to turn to the right. Sensor 35 may be disposed at various positions on the user's body or in proximity to the user, and may include, for example, an inclinometer or accelerometer. In one embodiment, one or more sensors 35 may be configured to detect a user's body motion or orientation may be disposed on the user's legs and arms.

Figure 7:
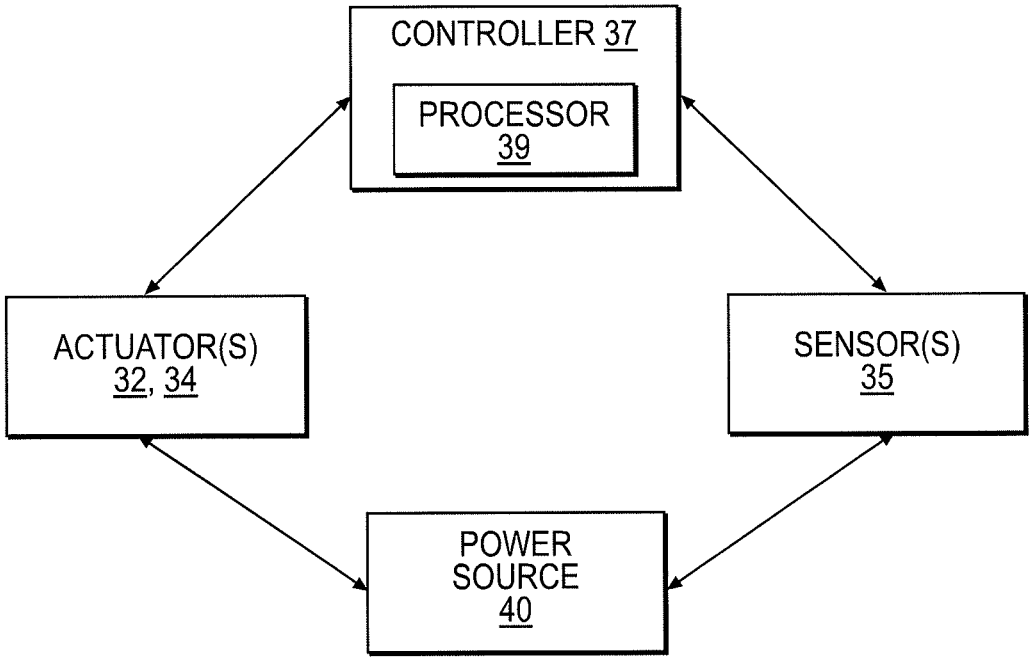
FIG. 7 includes a diagrammatic illustration of a system that may be used with the orthotic device of FIGS. 1A-6.

Controller 37 may receive an output signal from sensor 35, and may process the signal to control the orientation of actuators 32, 34, as described in greater detail hereinafter. As shown in FIG. 7, controller 37 may include a processor 39 having one or more processing devices configured to carry out a process for activating orthotic device 10. For example, processor 39 may be configured to receive an output signal from sensor 35 and monitor actuators 32, 34. In one embodiment, processor 39 may determine when to activate and de-activate actuators 32, 34. Controller 37 may include one or more wireless components configured to wirelessly communicate with actuators 32, 34 or sensor 35.

Power source 40 may include, for example, a battery configured to supply power to actuator system 30. In some embodiments, power source 40 may be a portable battery pack disposed remotely from frame system 20. For example, power source 40 may be worn on a belt around a user's waist or arm. In other embodiments, power source 40 may be secured to frame system 20, for example, power source 40 may be attached to leg holder 22 or foot plate 26. Additionally, power source 40 may be stored in a user's shoe proximate to frame system 20. In some embodiments, power source 40 may include one or more power sources, for example, a first power sources coupled to sensor 35 and a second power source coupled to actuators 32, 34. The first power source may be self-sufficient and disposed, for example, within foot plate 26. The second power source may include an external power source for actuators 32, 34. Additionally, the first and second power sources may include piezoelectric elements.

Actuating system 30 may be actuated and provide assistance to a user with a gait abnormality. Sensor 35 may, for example, sense when the user's foot hits the ground, and may send this information to controller 37. Processor 39 may make a determination that the user is walking forward. For example, sensor 35 may sense a shift in the foot indicative of forward movement. This may include a change in foot placement or a change in acceleration of the user. Based on this determination, processor 39 may activate actuator 32 and apply an upward pressure to portion A (FIG. 1B). This may lift portion A of the user, causing the user's heel to raise off the ground. A forward walking motion of the user and the lift of portion A may push off the user's forefoot (portion B) from the ground. Processor 39 may receive additional information from sensor 35, and may further determine that the user's heel is off the ground and the user has pushed off from the ground with the user's forefoot. Processor 39 may then deactivate actuator 32. At this time, processor 39 may activate actuator 34 and apply an upward pressure to portion B. This may lift portion B, cause the user's forefoot to raise upward and away from the ground. Upward movement of portion B may raise the user's toes upward, and may prevent the user from tripping on the toes when walking forward. Processor 39 may activate actuator 34 when the user's toes are still on the ground, allowing the toes to pivot upward when the user is moving forward.

Joint 29 may allow frame system 20 to bend and move with the user during this walking step. Actuator 34 may remain actuated until the user's foot again steps down on the ground, for example, when sensor 35 senses the user's foot hits the ground. Processor 39 may then deactivate actuator 34, and continue the cycle by activating actuator 32 to raise the user's heel.

Processor 39 may determine that the user intends to walk faster or slower. For example, processor 39 may receive a signal from sensor 35 indicating that the user has changed body motion or orientation. Based on this signal, processor 35 may determine the user's intentions and may activate actuators 32, 34 accordingly. In one example, processor 39 may receive a signal from sensor 35 that the user is leaning forward and may determine that the user desires to walk faster. Processor 39 may then activate and deactivate actuators 32, 34 in a faster cycle to increase the walking speed of the user. In some embodiments, processor 39 may determine that the user intends to turn to the left or right, and may activate actuators 32, 34 accordingly. In other embodiments, processor 39 may determine that the user does not wish to move forward. For example, sensor 35 may sense a substantial majority of the user's weight on the user's heel, rather than substantially even distributed across the user's foot. In this example, processor 39 may determine the user wishes to remain in place and may not activate actuators 32, 34.

Sensor 35 may additionally sense the orientation of the user's foot during a walking step to substantially prevent the foot from turning inward. Processor 39 may receive information from sensor 35 that the user's toes or ankles have slightly turned inward. Based on this information, processor 39 may activate actuator 34 and substantially rebalance the orientation of the user's foot. In one example, processor 39 may determine that a user's left foot has turned inward or begun to turn inward. Processor 39 may then activate actuator 34 on the outside of the foot (i.e., the top actuator in FIG. 1B) while actuator 34 on the inside of the foot (i.e., the bottom actuator in FIG. 1B) remain inactive. This may raise the outside of the user's forefoot and may substantially prevent or reduce the user's foot from turning inward while walking.

In a first exemplary embodiment, actuators 32, 34 may include a shape memory material, for example shape memory alloy including Nitinol wires. In one embodiment, the wires may be wound into longitudinal coils. Controller 37 may activate the wires by producing a change in voltage, for example, by applying a voltage across the wires. This may cause the wires to axially shorten, and thereby comprise a shorter longitudinal length. For example, the coils may compress into tighter coils. Controller 37 may discontinue the voltage to deactivate actuators 32, 34 based on a signal from sensor 35. This may cause the shape memory alloy wires to extend axially in length and return to a normal state. For example, the coils may longitudinally expand. Controller 37 may independently activate and deactivate actuators 32, 34 causing actuators 32, 34 to independently length and shorten. In some embodiments, activation of actuator 34 may deactivate actuator 32, and activation of actuator 32 may deactivate actuator 34. For example, actuator 34 may apply a restoring force to actuator 32, causing actuator 32 to deactivate.

In a second exemplary embodiment, actuators 32, 34 may include shape memory material comprised of electroactive polymers, for example, ferroelectric polymers, dielectric elastomers, and electrostrictive graft elastomers. In one embodiment, the electroactive polymers comprise silicon. Controller 37 may activate the electroactive polymers by, for example, stimulating the polymers with an electric field. This may cause the electroactive polymers to deform and axially shorten. Controller 37 may additionally discontinue the electric field and deactivate the electroactive polymers based on a signal received from sensor 35. Controller 37 may independently activate and deactivate actuators 32, 34 causing actuators 32, 34 to independently deform.

Additional exemplary embodiments may include actuators 32, 34 comprised of nanotechnology, ferro-fluid, magnetorheological fluid, electorheological fluid, piezoelectric polymers, electrostatic device, rotary motors, linear actuators, and pneumatic actuators. In one embodiment, actuators 32, 34 may include artificial muscle comprised of nanomaterials acting as an artificial muscle outside of a user's body. Additionally, any actuating process may be used that is suitable for an orthotic device.

Figure 8:
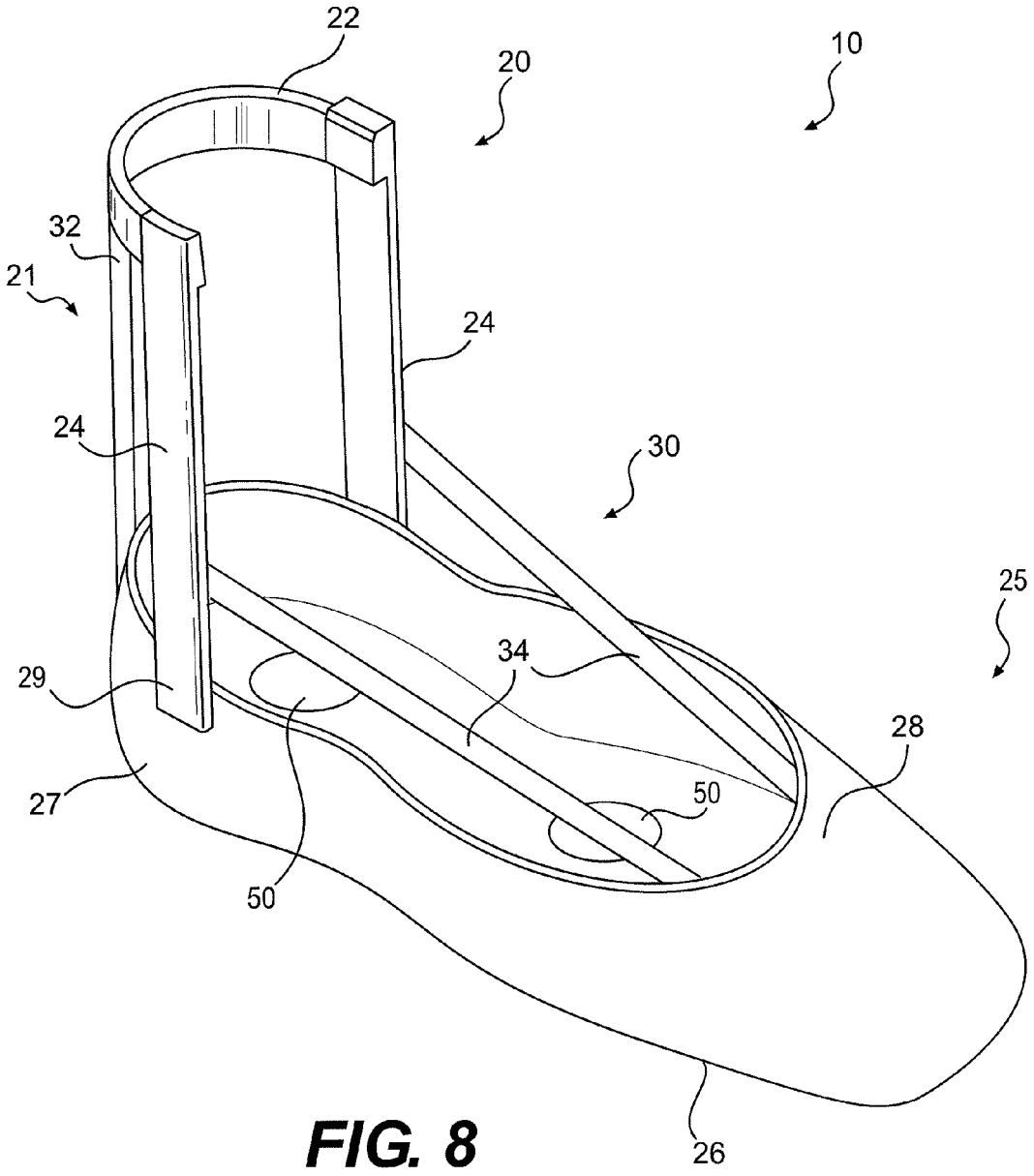
FIG. 8 includes a schematic illustration of another exemplary orthotic device.

In some embodiments, orthotic device 10 may additionally include electrical stimulation to provide rehabilitation and repair to damaged nerves and muscles. Additionally, the stimulation may increase muscle tone for a user. For example, as shown in FIG. 8, foot plate 26 may include or more electrical stimulators, such as electrodes 50, configured to apply an electrical stimulus to the user whether or not the user is walking. In some embodiments, electrodes 50 may utilize functional electrical stimulation (FES) or neuromuscular stimulation (NMES) to activate the user's nerves or muscles and restore function for the user. For example, electrodes 50 may stimulate a user's nerves, such as the peroneal nerve, to facilitate regrowth and repair of the damaged nerve. Electrodes 50 may be disposed on orthotic device 10 in any location sufficient to stimulate a desired nerve or muscle. For example, electrodes 50 may be disposed on foot plate 26. In other embodiments, electrodes 50 may be located proximate to orthotic device 10, for example, on a user's leg. In one embodiment, electrodes 50 may be positioned along a user's peroneal nerve to stimulate the nerve. Controller 37 may supply voltage to electrodes 50, and electrodes 50 may apply a constant stimulus or stimulation pulses.

As described above, the orthotic device of the present disclosure provides a walking aid for a user suffering from drop foot or any gait abnormality. The orthotic device may respond to a user's movement and may provide a toe push off, creating a more normal walking gait. Additionally, the compact and lightweight design of the orthotic device may enable the user to conceal the device under the user's clothes or within the user's shoe. Therefore, users requiring orthotic support may be more willing to wear the device. Additionally, the orthotic device may provide rehabilitation and repair of damaged nerves and muscles through stimulation.

It will be apparent to those skilled in the art that various modifications and variations can be made to the system of the present disclosure. Other embodiments of the system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. An orthotic device, comprising:

a frame system comprising a lightweight supportive material and configured to receive a user's foot;

a first actuator coupled to the frame system and configured to activate and develop push off of the forefoot of the users foot during a walking step;

a second actuator coupled to the frame system and configured to activate and raise the user's forefoot; wherein the first and second actuators include artificial muscles; and a sensor configured to detect a change in a user's foot motion or orientation, the sensor including an inflatable pouch, whereby an increase in pressure within the pouch is indicative of a foot strike.

2. The orthotic device of claim 1, wherein the sensor includes an inclinometer or an accelerometer.

3. The orthotic device of claim 1, further including a controller configured to receive a signal from the sensor to activate the first and second actuators.

4. The orthotic device of claim 3, wherein the controller is configured to activate the first and second actuators with a change in voltage.

5. The orthotic device of claim 1, further including a sensor configured to detect a walking intention of the user.

6. The orthotic device of claim 5, wherein the sensor includes an inclinometer or an accelerometer.

7. The orthotic device of claim 1, wherein the first and second actuators axially deform when activated and include materials selected from the group consisting of electroactive polymers and Nitinol.

8. The orthotic device of claim 1, wherein the first and second actuators comprise nanomaterials.

9. The orthotic device of claim 1, wherein the frame system includes a foot plate, a heel brace, and a leg holder.

10. The orthotic device of claim 1, furthering including one or more electrodes configured to stimulate a nerve or muscle.

11. An orthotic device comprising:

a foot plate configured to receive a users foot;

a heel brace connected to the foot brace and configured to receive the user's heel;

a leg holder pivotally connected to the heel brace;

a first actuator extending from the leg holder to the heel brace; and a second actuator extending from the leg holder to the foot plate;

wherein the leg holder includes an inflatable bladder.

12. The orthotic device of claim 11, further including a sensor and a controller in communication with the first and second actuators, the controller configured to regulate activation of the first and second actuators based on information received from the sensor.

13. A method of treating a gait abnormality, comprising:

sensing a change in foot motion or orientation of a user;

activating a first actuator based on the sensed change; and deactivating the first actuator and activating a second actuator, wherein activating the first actuator causes the user's heel to lift upward and activating the second actuator causes the user's forefoot to lift upward.

14. The method of claim 13, wherein activation of the second actuator causes the user to push off with the user's forefoot when stepping forward.

15. The method of claim 13, further including stimulating a nerve or muscle and rehabilitating the nerve or muscle.

16. The method of claim 15, wherein the stimulating the nerve includes stimulating the peroneal nerve with an electrode.

17. The method of claim 15, wherein activating the second actuator further includes substantially preventing the user's foot from turning inward.

18. An orthotic device, comprising:

a frame system including a foot insert surrounding a portion of a user's foot and a leg section operatively connected to the foot insert;

one or more actuators attached to the foot insert and the leg section for adjusting orientation of the foot insert relative to the leg section; and one or more sensors positioned in proximity to the user's foot and in communication with the frame system for detecting changes in the user's foot placement, and transmitting input associated with the changes to the actuators, wherein the input provided by the one or more sensors enables the actuators to adjust orientation of the user's heel and toes, so that the frame system provides push off from a user's forefoot during a walking step.

19. The orthotic device of claim 18, wherein the foot insert substantially conforms to at least the portion of the user's foot.

20. The orthotic device of claim 18, wherein the leg section is pivotally connected to the foot insert.

21. The orthotic device of claim 18, further including a controller for receiving the input from the one or more sensors and activating the one or more actuators in response to the input.

22. The orthotic device of claim 18, wherein the one or more actuators are independently lengthened and shortened in response to the input from the one or more sensors so that the user's foot is adjustably positioned and substantially prevented from turning inward.

23. The orthotic device of claim 18, wherein the actuators are independently adjusted in response to the input from the one or more sensors so that the user's foot is positioned in response to the orientation of the actuators.

24. The orthotic device of claim 18, further including electric stimulators for stimulating the user's nerve or muscle.

25. The orthotic device of claim 24, wherein the electrical stimulation maintains muscle tone for the user.

26. The orthotic device of claim 18, wherein the foot insert is substantially concealed from view when inserted within the user's shoe.

27. The orthotic device of claim 18, wherein the leg section is substantially rigid.

28. The orthotic device of claim 18, wherein the leg section includes an inflatable bladder.

29. The orthotic device of claim 18, further including a torsion spring configured to stimulate the motion of a user's ankle.

* * * * *